US006296422B1

(12) United States Patent
Ferraiolo

(10) Patent No.: US 6,296,422 B1
(45) Date of Patent: Oct. 2, 2001

(54) ELEMENT FOR FORMING GROUND COVERING, RESTRAINING AND REINFORCING STRUCTURES, PARTICULARLY FOR FORMING RETAINING WALLS

(75) Inventor: Francesco Ferraiolo, Ca' de' Fabbri (IT)

(73) Assignee: Officine Maccaferri S.p.A., Bologna (IT)

( * ) Notice: Subject to any disclaimer, the term of this patent is extended or adjusted under 35 U.S.C. 154(b) by 0 days.

(21) Appl. No.: 09/367,369

(22) PCT Filed: Feb. 24, 1998

(86) PCT No.: PCT/EP98/01050

§ 371 Date: Aug. 11, 1999

§ 102(e) Date: Aug. 11, 1999

(87) PCT Pub. No.: WO98/38391

PCT Pub. Date: Sep. 3, 1998

(30) Foreign Application Priority Data

Feb. 25, 1997 (IT) ..... BO97A0094

(51) Int. Cl.[7] ..... E02D 29/02
(52) U.S. Cl. ..... 405/262; 405/284
(58) Field of Search ..... 405/262, 284, 405/285, 286

(56) References Cited

U.S. PATENT DOCUMENTS 4,117,686 * 10/1978 Hilfiker ..... 405/284
4,391,557 * 7/1983 Hilfiker et al. ..... 405/284
4,505,621 * 3/1985 Hilfiker et al. ..... 405/284
4,856,939 * 8/1989 Hilfiker ..... 405/284
4,904,124 * 2/1990 Egan ..... 405/262
5,156,496 * 10/1992 Vidal et al. ..... 405/262
5,161,917 * 11/1992 Papetti ..... 405/284
5,531,547 * 7/1996 Shimada ..... 405/262
5,733,072 * 3/1998 Hilfiker et al. ..... 405/284

FOREIGN PATENT DOCUMENTS 0 197 000 * 3/1986 (EP) .

* cited by examiner

*Primary Examiner*—David Bagnell
*Assistant Examiner*—Frederick L. Lagman
(74) *Attorney, Agent, or Firm*—Flynn, Thiel, Boutell & Tanis, P.C.

(57) ABSTRACT

The subject of the invention is an element (1) for forming ground covering, restraining and reinforcing structures, particularly for forming retaining walls. The element (1) is constituted by a single wire-netting panel and is divided into a bottom portion (301), an intermediate front restraining portion (101), and a top end covering portion (201). These portions are delimited by reinforcing bars (2, 3) which are inserted in the mesh of the wire netting and which extend along the front portion (101) or define, between the portions (101, 201, 301), the predetermined bend lines for the formation of a substantially channel-shaped restraining element with a substantially vertical or inclined front wall. The structural element is filled with earth, stones or combinations of earth and stones (7, 7') and several channel-shaped layers each formed by an element (1) can be laid on top of one another to form retaining structures.

19 Claims, 2 Drawing Sheets

ELEMENT FOR FORMING GROUND COVERING, RESTRAINING AND REINFORCING STRUCTURES, PARTICULARLY FOR FORMING RETAINING WALLS

The invention relates to an element for forming ground covering, restraining and reinforcing structures, particularly for forming retaining walls, the element being constituted by a panel of wire netting, preferably with a double twist, in particular galvanized and possibly plastic-coated, the wire-netting panel being continuous and being divided into at least three portions comprising a bottom portion, a front restraining portion, and a top end covering portion, these portions being delimited relative to one another by reinforcing bars which are inserted in the mesh of the wire netting and which extend along or define predetermined lines for the bending of the three portions relative to one another, the three portions being bent relative to one another in a manner such as to form a substantially Channel-shaped restraining element having, for its base and its top, the two end portions of the element which are disposed substantially parallel to one another and, for a substantially vertical or inclined restraining wall, the intermediate portion between the two end portions, the restraining element being filled with earth, stones or combinations of earth and stones, and several Channel-shaped restraining elements each formed by a continuous element being able to be laid on top of one another to form walls or the like.

The object of the present invention is to devise a completely prefabricated element of the type described above so that it is possible, by means of inexpensive and relatively simple measures, to form structures such as walls or the like which are stronger and of more attractive appearance, particularly walls with surfaces having predetermined inclinations, without requiring operations to assemble the various components of the element in the place of use.

The invention achieves the above-mentioned object by means of an element of the type described at the beginning, in which the intermediate portion which is to form the vertical or inclined, visible restraining wall has at least one, and preferably several, further reinforcing bars inserted in the mesh of the wire netting and extending parallel to one another and parallel to the delimiting bars between the intermediate portion and the two opposed portions which are to form the base and top of the Channel-shaped restraining or reinforcing structure.

According to an improvement, when the visible portion of the Channel-shaped restraining structure formed by the netting element has to have a predetermined inclination relative to a perfectly vertical orientation, at least one, preferably two, and possibly even several brackets may be associated with each netting element in order to support it and position it in the correct inclined position, each bracket having at least a first arm which is a reinforcing bar and supports the intermediate portion for forming the visible front wall of the restraining element and which has the corresponding inclination, and at least a second arm parallel to the portion constituting the base.

The support and positioning brackets are preferably articulated to the front portion of the Channel-shaped element so as to be pivotable from a rest and storage position in which they are laid against the portion to which they are articulated and therefore extend parallel thereto, to an operative position in which they are arranged in a substantially raised and perpendicular position relative to the portion to which they are articulated.

The brackets are advantageously formed with the shape of a right-angled triangle or a right-angled trapezium.

A further characteristic of the invention consists of the fact that the element comprises, in addition to the wire netting panel, a so-called geosynthetic fines-retainer, this layer being superimposed inside the wire netting panel which is to form the front of the restraining element.

Two different versions of the geosynthetic layer may be provided, according to the use of the element. In the so-called earth version, the geosynthetic layer is preferably constituted by a bio-matting of natural fibres or the like. The layer of natural fibres may advantageously be reinforced by a netting of plastics material.

In the so-called water type, the geosynthetic layer is formed by a geo-matting of plastics material.

The front portion of the Channel-shaped element is also reinforced by a further netting panel (of the double-twisted or electrically-welded type) connected to the Channel-shaped element by staples at the production stage and thus enclosing the geosynthetic layer between the panel and the Channel-shaped element.

The above-mentioned measures strengthen the restraining element formed by the netting element, at least on the visible front portion of any walling. This is ensured both by the reinforcing bars, and by the positioning and support brackets, as well as by the reinforcing panel. The brackets enable the portion which forms the visible front wall of the restraining element to be positioned precisely in a predetermined manner, producing retaining walls with predetermined and precise inclinations.

The further reinforcing bars may possibly be used as intermediate predetermined bending hinges thus enabling visible front walls of different heights to be formed according to requirements. In this case, the brackets for supporting and positioning the portion which forms the visible front wall may also be replaceable or simply capable of being bent to height about predetermined bending hinges or the like.

The various types of geosynthetic material allow the restraining element to be adapted to various conditions of use of the structures formed with the elements according to the invention and improve the restraining characteristics and the aesthetic appearance of the structures, as well as their durability.

If the brackets for positioning and supporting the portion constituting the visible front wall are formed so as to be pivotable alternatively to the rest position or to the operative position, the element according to the invention can be folded at least partially onto itself to a storage or transportation position in which it has a minimal size vertically and in which it can be packed together with other elements, for example, in the form of a pack of elements laid on top of one another, bound and held together by heat-shrinkable film or the like.

The features of the invention are not structurally complex, involve considerable reductions in cost, and prevent laying complications and protracted laying times.

Further characteristics of the invention and improvements are the subjects of the dependent claims. The characteristics of the invention and the advantages resulting therefrom will become clearer from the following description of a non-limiting embodiment thereof illustrated in the appended drawings, in which:

Figure 1:
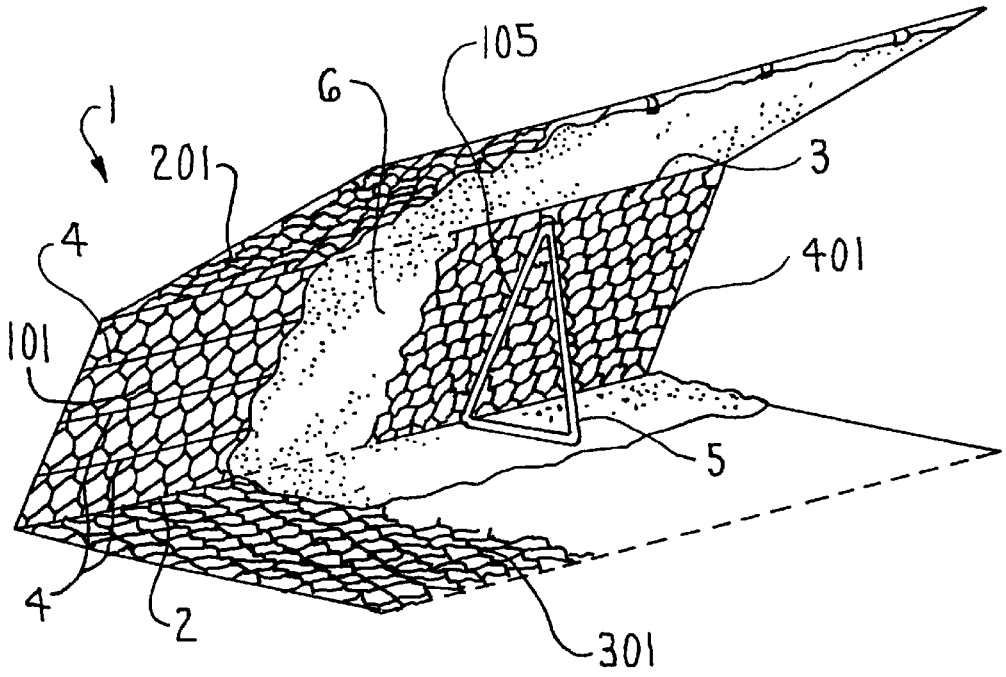
FIG. 1 is a schematic, perspective view of the element according to the invention, partially sectioned and in the course of being bent to form a restraining element.
Figure 7:
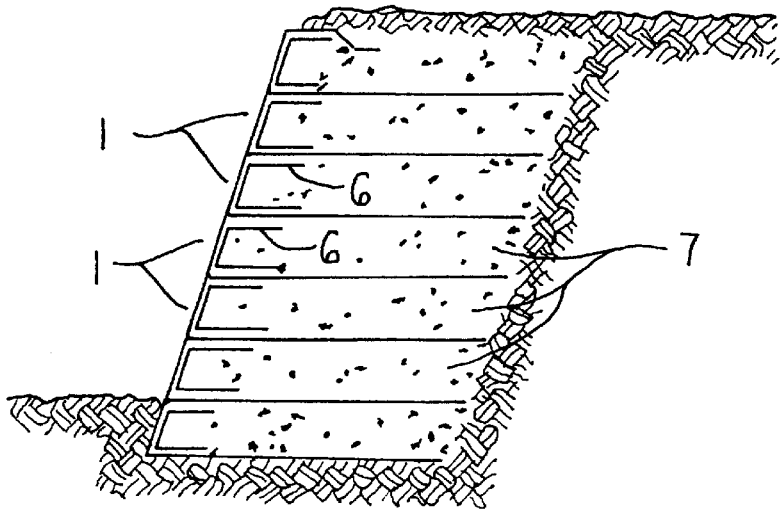
FIG. 7 shows in section a wall with an inclined front face produced by the laying of several restraining elements formed by elements according to the preceding drawings on top of one another.
Figure 2:
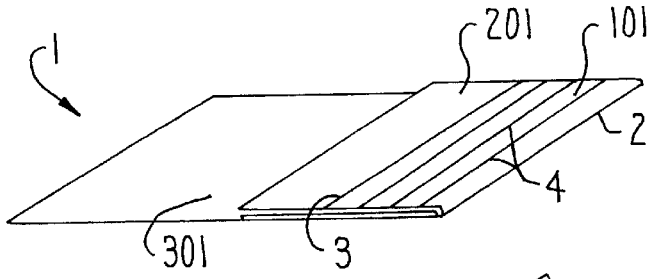
FIG. 2 shows the element of FIG. 1 in its folded position for transportation.
Figure 3:
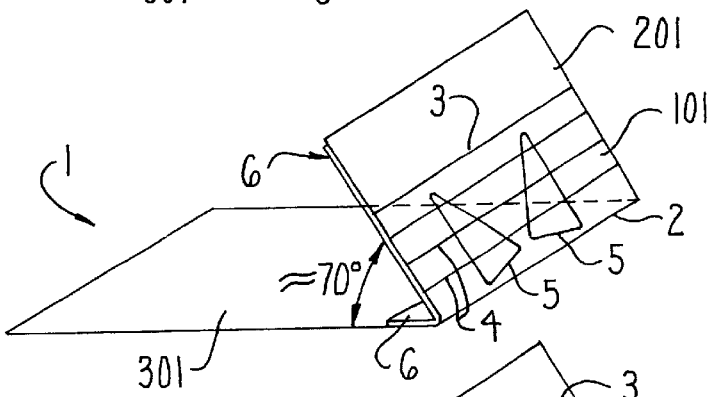
FIGS. 3 to 6 show the various stages of the formation and filling of the restraining element formed by the element according to the invention in order to form a wall with an inclined face.
Figure 4:
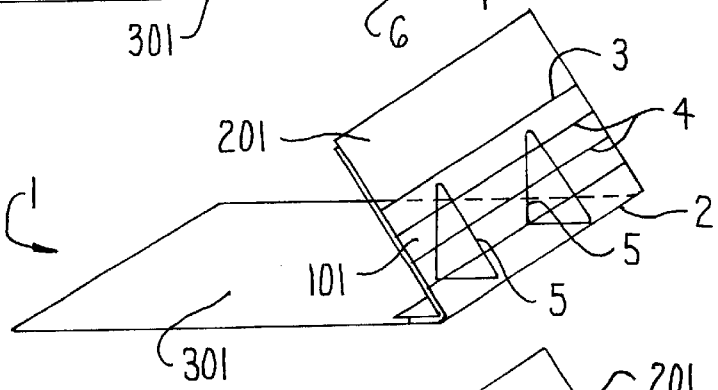
Figure 5:
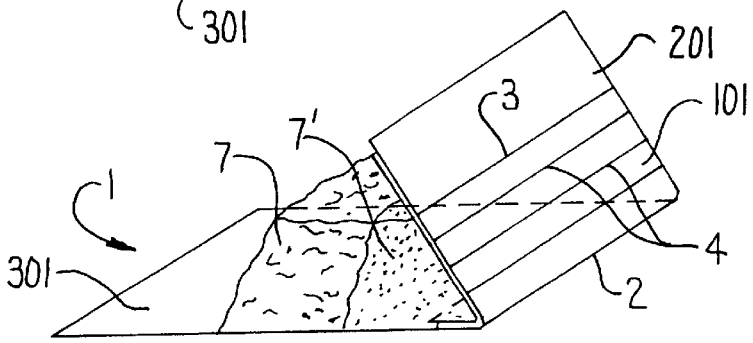
Figure 6:
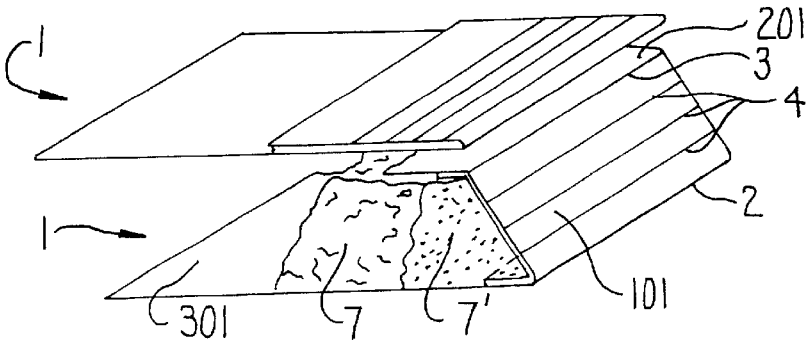

With reference to the drawings, an element 1 for forming ground covering, restraining and reinforcing structures, particularly for forming retaining walls (FIG. 7), is formed by a continuous wire-netting panel without any horizontal joints. The wire netting is preferably of the double-twist type with a hexagonal mesh. The wire netting is advantageously galvanized and/or plastic-coated.

The wire-netting panel is divided transversely into three regions comprising an intermediate portion 101 which is to form the visible front wall of the restraining element or structure and two end portions 201, 301 which are to form, respectively, a base and a top which, in the laid condition, extends at a certain distance from the base and is oriented substantially parallel thereto.

The bend lines which divide the intermediate portion 101 from the end portions 201, 301 are defined by metal bars 2, 3 which have the function of reinforcing the netting and define predetermined bend lines.

The intermediate portion 101 has further transverse bars 4, arranged parallel to the delimiting bars 2, 3 and preferably spaced apart uniformly. The intermediate bars are preferably spaced apart by a distance corresponding to one hexagonal mesh of the netting and, as well as reinforcing the intermediate portion 101 which constitutes the visible front wall of the restraining element, form further predetermined bend lines which enable visible front walls of different heights to be formed according to requirements.

Moreover, support and positioning brackets 5 are articulated to the intermediate portion 101 or can be articulated thereto by means of metal staples, rings or clips 105. These brackets are triangular and are pivotable from a rest or storage position in which they are folded against the inner side of the intermediate portion, to an operative position in which they are pivoted to a position substantially perpendicular to the intermediate portion 101.

The two brackets 5 thus enable the intermediate portion 101 to be positioned and at the same time supported in the correct operative position when the netting panel is bent to form the restraining element. In the rest position, on the other hand, the two brackets 5 are superimposed on the intermediate portion 101, allowing it to be folded against the portion 301 which is to form the base, the element as a whole adopting a condition of minimum height.

Naturally, the brackets 5 may be interchangeable for adaptation for bending at various heights along the intermediate bars 4, or may even be formed as adaptable elements, for example, so that they can be reduced in height by bending about predetermined hinges or bend lines, like the intermediate portion 101.

According to another characteristic, a layer of restraining material with a considerably smaller mesh size is superimposed on the netting inside the element 1. This layer of restraining material is particularly suitable for use with mixed stone and earth fillings or with earth alone. The restraining layer, indicated 6, and otherwise known as a geosynthetic layer, may be formed of various materials according to the conditions of use.

In use where it is not in contact with water and in conditions in which there is little erosive wash-out effect, it is possible to use a layer of woven or compacted natural fibres, possibly in combination with a supporting layer constituted by a netting of plastics material, as the fine-mesh restraining layer 6.

For use under water or in regions subject to a strong wash-out effect, the fine-mesh restraining layer 6 is constituted by a so-called geo-matting of plastics material, preferably polypropylene.

In order further to reinforce the visible front wall and to simplify adaptation operations by virtue of a certain modularity and compatibility, the brackets 5 are advantageously mounted on a bracket-holder panel 401 which is also made, for example, of wire netting and which is fixed in position, superimposed on the intermediate portion 101 which is to form the front wall and bracket-holder panels of different sizes are provided according to which bending bar 3, 4 is selected.

The fine-mesh restraining layer 6 is confined by the wire-netting panel 401 and is fixed to the Channel-shaped element by metal clips or the like.

Naturally, the brackets are fixed to the reinforcing panel, and hence to the intermediate portion 101, with the interposition of the fine-mesh restraining layer 6 between them and the panel.

FIGS. 2 to 6 show the ease with which the elements according to the invention can be laid. They are put in place and the unit constituted by the intermediate portion 101 and by the end portion 201 which forms the top of the Channel-shaped restraining element is raised, the two support and positioning brackets 5 being brought to the working position. The L-shaped element thus formed is then filled up to a predetermined level with earth, stones or mixtures of earth and stones (7, 7'). The top end portion 201 is then bent against the top of the filling 7. The bottom end portion 301 of a further element laid in the same manner as described above, may be supported and fixed on this top portion by suitable fastenings with staples. Walls such as that indicated in FIG. 7 can be formed by several elements laid on top of one another as described.

In this case, several elements 1 suitably bent and filled have been laid on top of one another forming an inclined wall. The support and positioning brackets 5 enable a front wall with a uniform and precise inclination to be produced.

Naturally, if different slopes are required for different regions or levels of the wall, elements having support and positioning brackets 5 of different shapes may be used so as to give the intermediate portion 101 a different inclination.

Again, according to the type of use or purpose, the entire space defined by the element 1 bent to form a Channel-shaped restraining element may simply be filled with earth, or the filling in the head region directly adjacent the visible front wall may be constituted by broken stone or broken stone bound with earth and the filling may advantageously be shaped, in cross-section, like an isosceles trapezium, the inclined portion opposite the front wall having an inclination symmetrically opposite that of the front portion.

Naturally, the invention is not limited to the embodiments just described and illustrated but may be varied widely, particularly structurally, without thereby departing from the protective scope set out above and claimed below.

What is claimed is:

1. An element for forming ground covering, restraining, and reinforcing structures, particularly for forming retaining walls, the element comprising a continuous panel of wire netting comprising at least a bottom portion which defines a base, an intermediate front restraining portion, and a top end covering portion, the intermediate portion forming a visible front wall of a restraining wall and being divided by bend lines from the bottom and the top portions so as to form a substantially channel-shaped restraining element, comprising the improvement wherein the element includes at least one support and positioning bracket coupled to the intermediate portion and insisting on the bottom portion, such that the at least one support and positioning bracket supports and positions the intermediate portion which is to form the visible front wall in a substantially vertical or inclined position relative to the bottom portion.

2. An element according to claim 1, wherein the element includes a plurality of reinforcing bars, and the bottom, intermediate and top portions are delimited relative to one another by the reinforcing bars which define predetermined lines for the bend lines to permit bending of the bottom, intermediate and top portions relative to one another so as to form the substantially channel-shaped restraining element, at least one of the reinforcing bars being disposed on the intermediate portion between the bend lines.

3. An element according to claim 2, wherein the at least one reinforcing bar in the intermediate portion of the element is a transverse bar inserted in a mesh of the wire netting and extending parallel to the reinforcing bars which delimit and define the bend lines between the intermediate portion and the bottom and top portions, said bottom and top portions respectively defining the base and the top of the Channel-shaped restraining element.

4. An element according to claim 3, wherein the at least one transverse bar for reinforcing the intermediate portion further defines a predetermined intermediate hinge or bend line which permits bending of the intermediate portion and enables visible front walls of different heights to be formed.

5. An element according to claim 1, wherein the at least one support and positioning bracket is articulated to one of the portions of the element so as to be pivotable between a rest and storage position in which the bracket is laid against the one portion to which the bracket is articulated and therefore extends substantially parallel thereto, and an operative position in which the bracket is arranged substantially perpendicularly relative to the one portion to which the bracket is articulated.

6. An element according to claim 1, wherein the at least one support and positioning bracket for supporting and positioning the visible front wall is formed with a shape of a triangle or a trapezium.

7. An element according claim 1, wherein the element comprises at least two reinforcing bars disposed on the intermediate portion so as to define at least one transverse bar and a first arm of the at least one support and positioning bracket, the at least one support and positioning bracket for supporting and positioning the visible front wall being replaceable or adaptable in height in accordance with the bend lines.

8. An element according to claim 7, wherein the at least one support and positioning bracket for positioning and supporting the visible front wall is formed as a modular element which can be fitted on and removed from the element.

9. An element according to claim 1, wherein the visible front wall is reinforced by a further reinforcing panel of double-twisted or electrically-welded wire netting which is joined to the element so as to support the intermediate portion, the at least one support and positioning bracket being fixed to the reinforcing panel.

10. An element according to claim 9, wherein the element comprises a geosynthetic restraining layer with a finer mesh which is included between the intermediate portion of the wire netting panel and the further reinforcing panel inside the element.

11. An element according to claim 10, wherein the geosynthetic layer is selected according to the conditions of use of the element among a group comprising a layer formed by natural fibres in the form of bio-matting, alone or in combination with a reinforcing netting of plastics material, and a layer formed by a geo-matting of plastics material.

12. An element according to claim 10, wherein the at least one support and positioning bracket is articulated to one of the portions of the element so as to be pivotable between a rest and storage position in which the bracket is laid against the one portion to which the bracket is articulated and therefore extends substantially parallel thereto, and an operative position in which the bracket is arranged substantially perpendicularly relative to the one portion to which the bracket is articulated in a rest or storage position, the top end covering portion which forms a top of the element and the intermediate portion which forms the visible front wall being folded against the base with the interposition of the geosynthetic layer, the reinforcing panel, and the at least one positioning and support bracket in a rest position laid against the one portion to which the support and positioning bracket is articulated, several said elements being able to be stored or packed in the form of a pack comprising several said elements laid on top of one another and bound in a heat-shrinkable sheet.

13. An element according to claim 1, wherein the Channel-shaped restraining element formed by each said element is filled with earth, stones and/or soil of any composition to define a rigid structure.

14. An element according to claim 1, wherein in a region adjacent the intermediate portion which forms the visible front wall, a filling is provided therein, the filling defined by crushed stone bound with earth.

15. The element according to claim 14, wherein the filling of crushed stone bound with earth is provided on an inner side of the intermediate portion, the intermediate portion having an inclined face on the opposite outer side of the intermediate portion of the element, the intermediate portion having an opposite face on the inner side with a symmetrically opposite inclination, on which a filling of earth of any kind bears.

16. An element according to claim 1, wherein the at least one support and positioning bracket is disposed on an inner side of the intermediate portion and prevents movement of the intermediate portion toward the bottom portion.

17. An element for forming ground covering, restraining and reinforcing structures, particularly for forming retaining walls, the element comprising:

a continuous panel of wire netting comprising at least a bottom portion which defines a base, an intermediate front restraining portion adjacent said bottom portion, and a top end covering portion adjacent said intermediate portion, the intermediate portion being divided by bend lines from the bottom and the top portions, the bottom and the top portions being bendable rearwardly about the bend lines to form a substantially channel-shaped restraining element having an inner region disposed rearwardly of the intermediate portion for receiving fill material therein during use; and at least one support and positioning bracket which extends between the intermediate portion and the bottom portion and is disposed within the inner region to position the intermediate portion in a substantially vertical or inclined operative position relative to the bottom portion and support the intermediate portion wherein the at least one support and positioning bracket prevents movement of the intermediate portion rearwardly from the operative position toward the bottom portion.

18. An element according to claim 17, wherein said at least one support and positioning bracket is coupled to the intermediate portion and insists upon the bottom portion when the intermediate portion is in the operative position.

19. An element according to claim 18, wherein the at least one support and positioning bracket is fixed to one of the intermediate portion and the bottom portion and is separated from the other of the intermediate portion and the bottom portion when the intermediate portion is bent forwardly of the operative position.

* * * * *